US007777683B2

(12) United States Patent
Tageman et al.

(10) Patent No.: US 7,777,683 B2
(45) Date of Patent: Aug. 17, 2010

(54) FERROELECTRIC LENS

(75) Inventors: Ola Tageman, Gothenburg (SE); Spartak Gevorgyan, Gothenburg (SE); Anatoli Deleniv, Gothenburg (SE); Pierre Filhol, Pessac (FR); Vladimir Cherman, Chavannes pres Renens (CH)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 487 days.

(21) Appl. No.: 11/721,271

(22) PCT Filed: Dec. 8, 2004

(86) PCT No.: PCT/SE2004/001822

§ 371 (c)(1),
(2), (4) Date: Jun. 8, 2007

(87) PCT Pub. No.: WO2006/062446

PCT Pub. Date: Jun. 15, 2006

(65) Prior Publication Data

US 2009/0237322 A1 Sep. 24, 2009

(51) Int. Cl.
*H01Q 19/06* (2006.01)

(52) U.S. Cl. ..... 343/753

(58) Field of Classification Search ..... 343/753–757, 343/787, 778, 909

See application file for complete search history.

(56) References Cited

U.S. PATENT DOCUMENTS 5,309,166 A * 5/1994 Collier et al. ..... 343/778
5,729,239 A * 3/1998 Rao ..... 343/753
6,313,804 B1 * 11/2001 Falk ..... 343/757
6,518,850 B1 * 2/2003 Falk et al. ..... 332/144
6,538,603 B1 * 3/2003 Chen et al. ..... 342/372

FOREIGN PATENT DOCUMENTS

| | | |
|---|---|---|
| WO | WO 9310571 A1 | 5/1993 |
| WO | WO 9722158 A1 | 6/1997 |
| WO | WO 0024080 A1 | 4/2000 |

OTHER PUBLICATIONS

"Voltage-Controlled Ferroelectric Lens Phased Arrays" IEEE Transactions on Antennas and Propagation, pp. 458-468, vol. 47, No. 3 1999.

* cited by examiner

*Primary Examiner*—Huedung Mancuso
(74) *Attorney, Agent, or Firm*—Roger S. Burleigh

(57) ABSTRACT

A lens (300, 500) is disclosed for steering the exit direction (Ω) of an incident electromagnetic wave. The lens comprises a main body (210, 510) of a ferroelectric material with a first main surface (207, 507) and a first transformer (220, 222). The electromagnetic wave enters and exits the lens through the transformer, and the lens comprises means (370, 380) for creating a DC-field in a first direction in the main body. The main body (210, 510) of ferroelectric material comprises a plurality (21011-210NN, 51011-510NN) of slabs of the ferroelectric material, each slab also comprising a first (403, 603) and a second electrode of a conducting material. The means for creating a DC-field can create a gradient DC-field in the first direction using the first and second electrodes, so that the dielectric constant in the main body will also be a gradient in the first direction, thus enabling steering of the existing electromagnetic wave.

8 Claims, 13 Drawing Sheets

FERROELECTRIC LENS

TECHNICAL FIELD

The present invention relates to a lens for steering the exit direction of an electromagnetic wave which is incident upon the lens, said lens comprising a main body of a ferroelectric material with at least a first main surface and a first transformer which is adjacent to said first main surface of said ferroelectric body. The lens additionally comprises means for creating a first DC-field in a first direction in the main body, and the incident electromagnetic wave will enter and exit the lens through the transformer.

BACKGROUND ART

Ferroelectric materials have a dielectric constant which can be altered if a DC-field is induced in the material. This property has been used to manufacture lenses of ferroelectric materials for electrical steering of electromagnetic beams, such as an antenna beam, the beam being the "output" from the lens of an electromagnetic field which has been incident upon the lens.

A lens which is made from a ferroelectric materials and which is used for electrically steering the exit direction of a beam which is incident upon the lens and exits the lens is known from IEEE Transactions on Antennas and Propagation, pp 458-468, volume 47, no 3 1999, "Voltage-Controlled Ferroelectric Lens Phased Arrays".

A drawback of the device discussed in this article is the complexity of the design and the price. The device uses a multitude of traditional waveguides filled with ferroelectric materials and input/output matching sections which would increase the cost of the device.

Another ferroelectric beam-steering lens is known from 33$^{rd}$ EuMC WS6 proceedings, pp 79-82. Drawbacks of the device disclosed in this paper seem to be a very high charging time constant, as well as quite a high voltage (in the order of magnitude of 20 kV) needed to drive the lens. Additionally, the fabrication of a large area ferroelectric plates (lens) as disclosed in this paper is complicated—it is hard to fabricate the large size (>5×5 cm$^2$) plates of the design with acceptable densification and uniformity.

SUMMARY OF THE INVENTION

There is thus a need for a ferroelectric lens for steering the output direction of an incident electromagnetic beam which is less expensive and less complex to manufacture than those known at present. In addition, such a new lens should also need lower driving voltages than lenses which are known at present.

These needs are addressed by the present invention in that it discloses a lens for steering the exit direction of an electromagnetic wave which is incident upon the lens, the lens comprising a main body of a ferroelectric material with at least a first main surface, also comprising a first transformer which is adjacent to said first main surface of said ferroelectric body.

The electromagnetic wave will enter and exit the lens through the transformer, with the lens additionally comprising means for creating a first DC-field in a first direction in the main body.

According to the invention, the lens's main body of ferroelectric material comprises a plurality of discrete slabs of the ferroelectric material, each slab in said plurality also comprising a first and a second electrode of an electrically conducting material. Also, the means for creating a DC-field can create a gradient DC-field in said first direction, using the first and second electrodes in the plurality of slabs, by means of which the dielectric constant in the main body will also be a gradient in said first direction, thus enabling steering of the exiting electromagnetic wave, and offer design flexibility with low expenses.

Thus, by means of the invention, a beam-steering lens made from a ferroelectric material is obtained which will be less expensive to produce than previously known such lenses, and, as will become apparent from the more detailed description, will also require much lower control voltages than previously known such lenses.

Suitably, the means for creating a DC-field are adapted to create said first DC-field in a first direction which is essentially parallel to said first main surface of the main body.

In a preferred embodiment of the invention, the lens additionally comprises a second transformer, and the main body of ferroelectric material has a second main surface, with each of the first and second transformers being arranged adjacent to one of the main surfaces of the main body, so that the electromagnetic wave will enter the lens through one of the transformers and exit through the other of the transformers.

BRIEF DESCRIPTION OF THE DRAWINGS

The invention will be described in more detail with reference to the appended drawings, in which.

EMBODIMENTS

Figure 1:
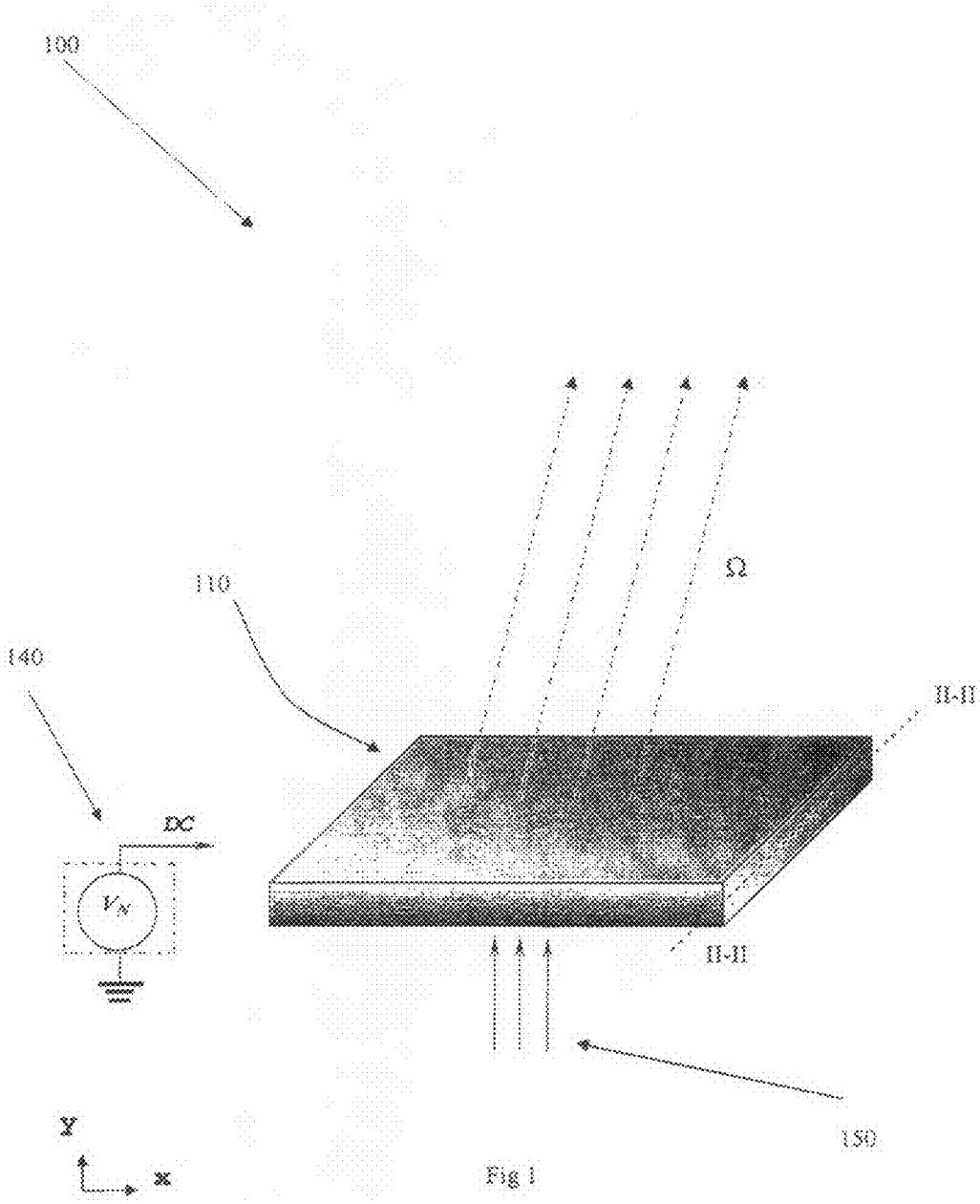
FIG. 1 shows a diagram of the principles of a lens according to the invention.

FIG. 1 illustrates some of the basic principles of a lens 100 according to the invention. As shown in the drawing, the invention comprises a lens 100 which in turn comprises a body 110 of a ferroelectric material. One property of a ferroelectric material is that the dielectric constant, $\in$, of the material can be changed by subjecting the material to a DC-field.

As illustrated schematically in FIG. 1, the lens of the invention comprises means 140 for creating a DC-field to be applied to the body 110 of ferroelectric material. If the DC-field which is created over or in the ferroelectric body is not constant, but is instead a gradient in at least one direction, the dielectric constant, $\in$, of the ferroelectric body will vary according to the gradient of the DC-field.

An application of the ability to change the dielectric constant of the body of ferroelectric material is shown in FIG. 1: a plane electromagnetic wave 150 is incident upon a first main surface of the body 110, the incident direction being normal to the first main surface. The wave enters the body 110 through the first main surface, and exits through a second main surface of the body.

According to the invention, the DC-means 140 are used to create a DC-field in a first direction in the body 110, the direction shown in FIG. 1 being indicated by an arrow and being parallel to one edge of the body which is shown as having an essentially square or rectangular shape. The direction of the DC-field created by the DC-means is in the direction denoted as "x" in a coordinate system shown in FIG. 1, the x-axis coinciding with said edge of the essentially square body. As mentioned, the DC-field created in the lens 100 of the invention is a gradient, thus in this case a DC-gradient is created along the x-direction of the lens.

A result of the gradient DC-field is also shown in FIG. 1: the plane electromagnetic wave 150 which enters the ferroelectric body 110 through the first main surface of the ferroelectric body 110 at an incident angle which is normal to the first main surface exits the lens through the second main surface of the body at a direction which deviates an angle Ω from the normal.

The fact that the exit direction of an incident wave can be changed by means of imposing a gradient DC-field upon the ferroelectric body means that a lens according to the invention can be used as a beam steering device. The device 100 shown in FIG. 1 only serves to illustrate the basic principle behind the invention, the description will now show the invention in closer detail.

Figure 2:
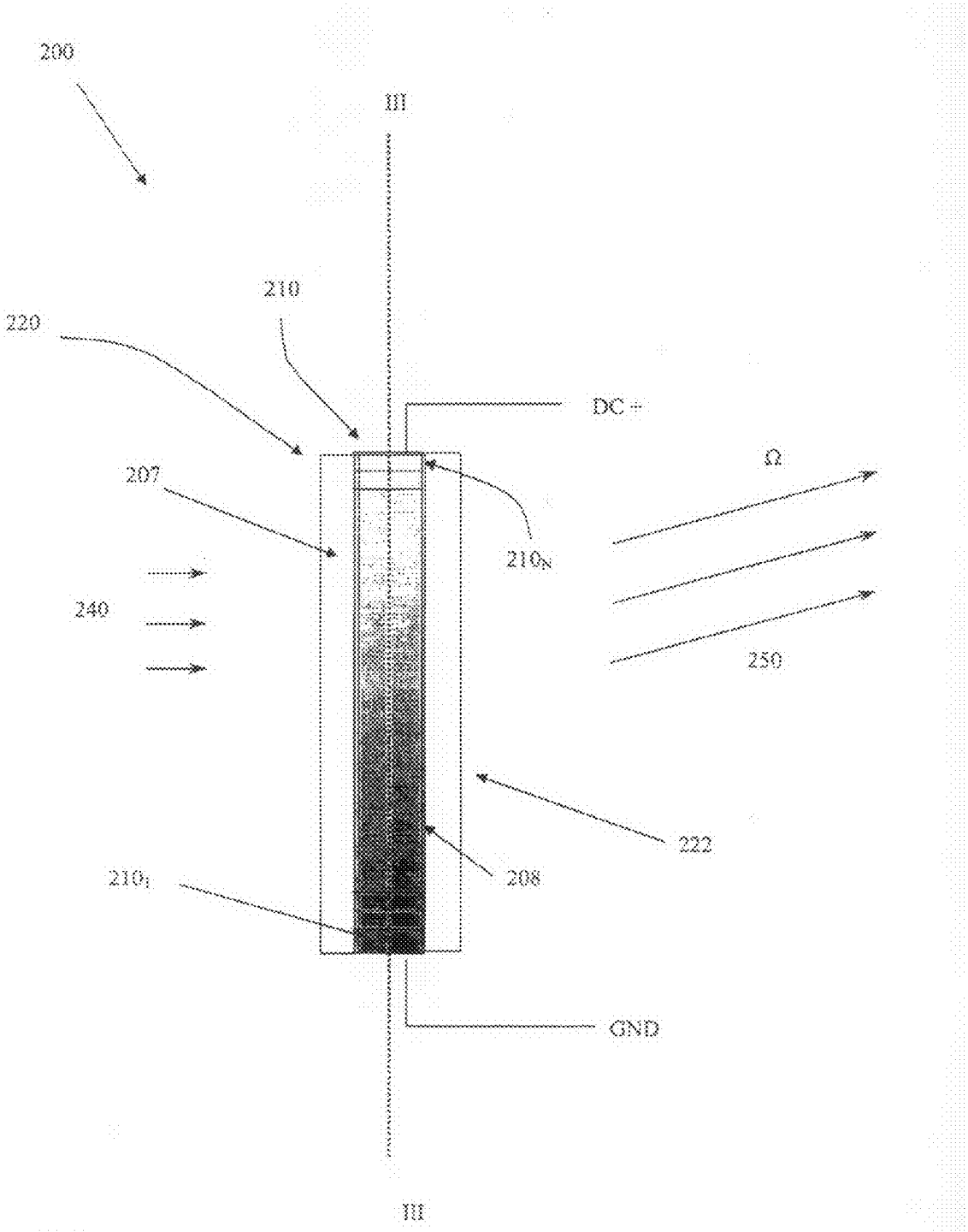
FIG. 2 shows a lens according to the invention in cross-section from the side.

FIG. 2 shows a lens 200 of the invention in a cross-section along the dotted line II-II in FIG. 1: as with the lens 100 of FIG. 1, the lens 200 in FIG. 2 comprises a body 210 of a ferroelectric material, which will be described in more detail later. The body 210 also exhibits a first main surface 207.

In addition, which was not shown in FIG. 1, the lens 200 of FIG. 2 comprises a matching transformer 220 which is arranged adjacent to the first main surface 207 of the ferroelectric body 210. The function of the transformer 220 is to facilitate the entry and exit of an electromagnetic wave between the lens and the ambient atmosphere, which will be described in more detail later.

Thus, there should suitably also be a transformer where a wave will exit the lens. This can be accomplished by letting the transformer 220 surround the lens at both the intended entry and exit surfaces for the wave, i.e. by letting the first transformer be in one solid contiguous piece, or, as shown in FIG. 2, by letting the lens 200 of the invention comprise a second transformer 222 in addition to the first transformer 220, the second transformer being arranged adjacent to the intended exit surface of the electromagnetic wave, i.e. adjacent to a second main surface 208 of the body 210.

As shown in FIG. 2, the ferroelectric body 210 is suitably shaped as a rectangular box, so that the first 207 and second 208 main surfaces of the body 210 become two opposing main surfaces of the box.

Also, according to the invention, as shown in FIG. 2, the ferroelectric body 210 comprises a plurality of discrete slabs $\mathbf{210}_1$-$\mathbf{210}_N$. As shown in FIG. 2, the slabs $\mathbf{210}_1$-$\mathbf{210}_N$ are stacked adjacent to each other, in this example on top of each other, to form the ferroelectric body 210.

Thus, a plane electromagnetic wave 240 which is incident upon the lens 200 in a direction normal to the first main surface 207 of the body of ferroelectric material 210 will enter the lens through the first transformer 220 and the first main surface 207 and exit the body 210 through the second main surface 208 and the second transformer 222.

As illustrated in FIG. 2, and as explained previously, the direction of the exiting wave 250 can be controlled by means of introducing an electrical field in the body 210 so that an electrical gradient is formed, suitably having a maximum at an "end slab" $\mathbf{210}_1$ or $\mathbf{210}_N$ and a corresponding minimum at another "end slab".

Accordingly, the lens of the invention comprises means (DC+, GND) for introducing a first DC-field in a first direction in the main body. This will now be described in more detail with reference to FIG. 3.

Figure 3:
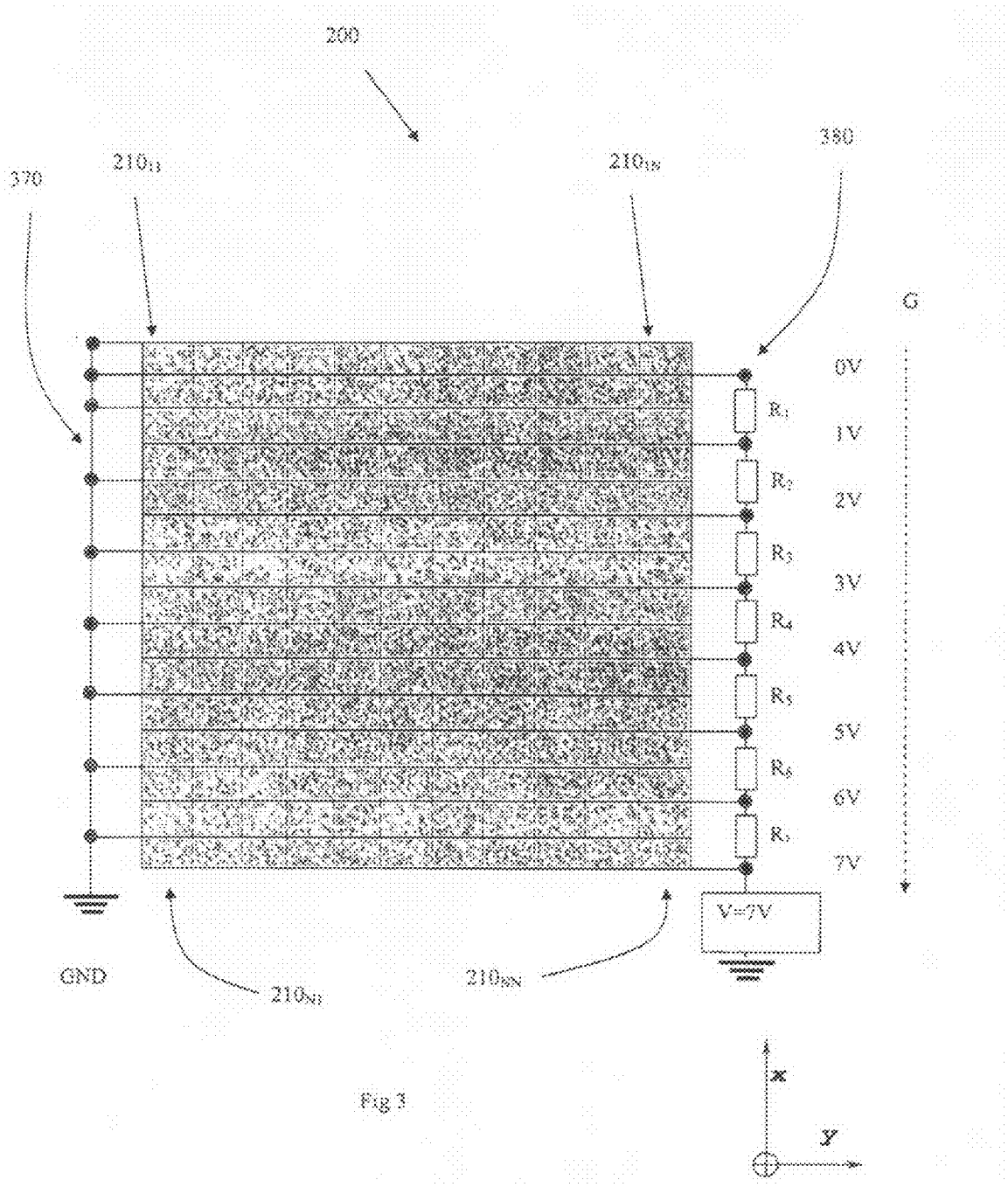
FIG. 3 shows a cross-section of a main surface of a first embodiment of a lens of the invention.

FIG. 3 shows the lens 200 from FIG. 2 in a cross-sectional front view along the dashed line III-III shown in FIG. 2. FIG. 3 clearly shows the composition of the body 210, with a plurality of slabs, the slabs in this particular case being elongated box-like structures arranged as a matrix in rows and columns, so that each slab, as shown on the drawing, can be seen as an element in a two-dimensional matrix, $\mathbf{210}_{11}$-$\mathbf{210}_{NN}$.

The matrix is of course only one suitable form for the ferroelectric body 210, as is the elongated box-like shape of the individual slabs, many other forms of slabs and ferroelectric bodies can be realized within the scope of the invention. For example, in this particular embodiment, each row, i.e. elements $\mathbf{210}_{11}$-$\mathbf{210}_{1N}$ etc. can be one contiguous slab, so that the body 210 instead comprises a plurality of "boards" arranged on top of each other.

As mentioned previously, the lens of the invention also comprises means for creating a DC-field gradient in the lens. These means can be seen more clearly in FIG. 3, and in this example comprise a first set of "ground lines" 370 and a second set of DC-lines 380.

As can be seen, the ground lines 370 are connected to a common ground point GND, and the DC-lines are connected to a DC-power supply "V". Before the means for creating the DC-field are described further, the individual elements, the "slabs" of the ferroelectric body 210 will now be described in more detail, with the aid of FIG. 4.

Figure 4:
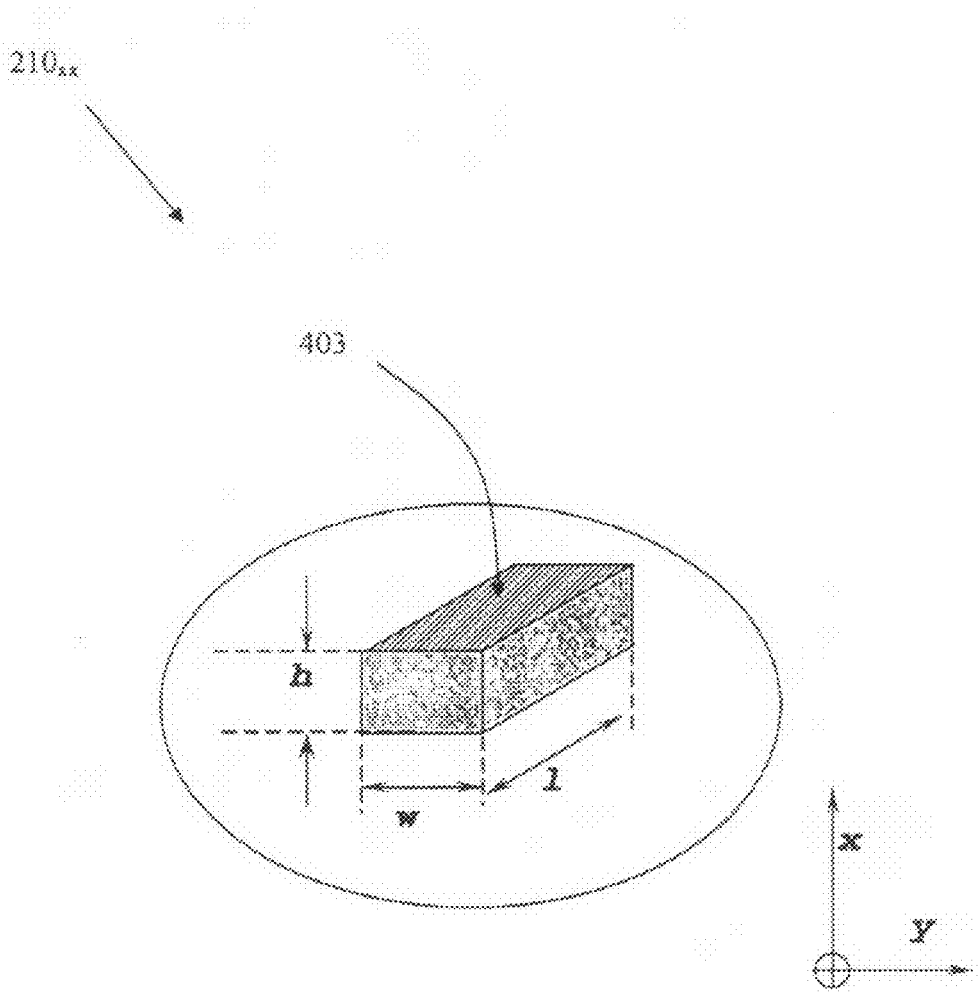
FIG. 4 shows a component in the first embodiment of a lens of the invention.

FIG. 4 shows one of the slabs $\mathbf{210}_{XY}$ of the matrix shown in FIG. 3. As can be seen from FIG. 4, the slab is rectangular and box-like, with a width w, a height h and a length l. It is the two surfaces (front and rear "face" of the slab) defined by the width w and the height h which form the first and second main surfaces 207, 208, of the body 210 of ferroelectric material.

According to the invention, the slabs in the matrix, as shown in FIG. 3, comprise a first and a second electrode of an electrically conducting material, such as, for example, Ag, Au, Pt or Pd. With the slabs having the shape shown in FIG. 4, the electrodes are suitably arranged on a top 403 and bottom surface of the slab. Thus, with the coordinate system shown at the bottom right of FIG. 4, two slabs which are arranged adjacent to each other in the x-direction will have mechanical and galvanic contact between the top electrode of one slab and the bottom electrode of the other slab. Due to the electrodes, each individual slab $\mathbf{210}_{11}$-$\mathbf{210}_{NN}$ can be seen as an elementary TEM-waveguide.

Returning now to FIG. 3 and the means for creating a DC-field, as mentioned above, these means comprise a first set of ground lines 370 and a second set of DC-lines 380.

Let's consider the slabs in the "rightmost" column, i.e. slabs $\mathbf{210}_{1N}$, $\mathbf{210}_{2N}$ . . . $\mathbf{210}_{NN}$. Slab $\mathbf{210}_{1N}$ is arranged so that its bottom electrode is in contact with the top electrode of the slab immediately below it, i.e. slab $\mathbf{210}_{2N}$. This is the principle adhered to with all of the slabs (except, for natural reasons, the uppermost and lowermost of the slabs) in any specific column: the bottom electrode of each slab is in contact with the top electrode of the slab immediately below it.

A number of connection points are thus created at the intersection between two slabs, where each connection point comprises the bottom electrode of one slab and the top electrode of the next slab immediately below. If the two electrodes do not extend to the sides of the slabs so that the connection points can not be accessed at the sides, an extra conductor can be introduced to facilitate electrical access to the meeting points of the two electrodes.

Thus, at the intersections or connection points between two slabs, it will be possible to establish a potential by connecting the connecting point to a DC-feed. This is what is done in the embodiment of FIG. 3: there is a first potential line 370 connected to ground, and a second potential line 380 connected to a DC-supply. By means of these two potential lines, the gradient field in the ferroelectric body 210 is created, in the following manner: the second potential line 380 is connected to a DC-supply, and comprises a number of voltage dividers, in this case resistors.

FIG. 3 shows seven resistors, so let's assume, for the sake of simplicity, that $V_{DC}$=7 Volts. Needless to say, the number of resistors and the amplitude of the DC-voltage are merely examples, the number of resistors and the DC-amplitude can be varied as necessary, according to the application.

Using $V_{DC}$=7V, there will then be a voltage of 1 V across each resistor, with the voltage between any one resistor and ground being shown next to the resistors, said voltage to ground varying as a gradient from 0 to 7 volts.

With the exception of the first slab, i.e. slab $\mathbf{210}_{1N}$, the electrode on one side (top/bottom) of each slab will be connected to a point in the ground line 370, and the electrode on the other side (bottom/top) of the same slab will be connected to a point in the second potential line 380.

Thus, one of the electrodes in each slab will be connected to ground, and the other electrode will be connected to the potential line supplied by the DC-feed.

In order to create the desired DC-gradient over the slabs, starting from the slab which will be the lowest potential in the DC-gradient, and going in the direction of the desired gradient, each slab is connected to a point in the second potential line 380 which has a higher potential than the point in the next slab which is connected to the second potential-line 380.

In order to facilitate the understanding of this, FIG. 3 shows the voltage on each side of each resistor in the second potential line 380.

In order to further facilitate the understanding of this principle, the table below shows, for the slabs in the rightmost column, column N, the potential between the point in the slab which is connected to the DC-line and ground. Since there are 16 rows shown in the drawing, which is of course merely an example, the slab at the bottom right hand corner will here be denoted $\mathbf{210}_{16,N}$.

| Slab | Voltage |
|---|---|
| $210_{1,N}$ | 0 |
| $210_{2,N}$ | 0 |
| $210_{3,N}$ | 1 |
| $210_{4,N}$ | 1 |
| $210_{5,N}$ | 2 |
| $210_{6,N}$ | 2 |
| $210_{7,N}$ | 3 |
| $210_{8,N}$ | 3 |
| $210_{9,N}$ | 4 |
| $210_{10,N}$ | 4 |

-continued

| Slab | Voltage |
|---|---|
| $210_{11,N}$ | 5 |
| $210_{12,N}$ | 5 |
| $210_{13,N}$ | 6 |
| $210_{14,N}$ | 6 |
| $210_{15,N}$ | 7 |
| $210_{16,N}$ | 7 |

Thus, there is a DC-gradient created over the body 210 of ferroelectric material, the gradient being indicated by the arrow G in FIG. 3. The DC-gradient in turn creates a gradient in the dielectric constant $\in$ in the body, the $\in$ decreasing in the same direction as the DC-voltage increases, i.e. the higher DC-field biasing, the lower the $\in$ of the ferroelectric material.

Since it is possible to control the gradient by means of controlling the potential line 380, it will now be realized that this control can also be used to control the output direction $\Omega$ of the exiting electromagnetic wave 250 which was shown and described in connection with FIG. 2. Thus, by using the DC-means shown in FIGS. 2 and 3 and described above, it will be possible to control the exit direction of the electromagnetic wave in the "x"-direction, with reference to the coordinate system shown in FIG. 3.

Another important principle of the invention will also have emerged from the description of the DC-means or biasing means: the DC-field which is created in a lens of the invention will be essentially parallel to the E-field of the incident electromagnetic wave shown in FIG. 2. This allows for greater tuning precision than in previously known designs, where the two E-fields (biasing field and incident wave field) have often been more or less orthogonal to each other.

Figure 5:
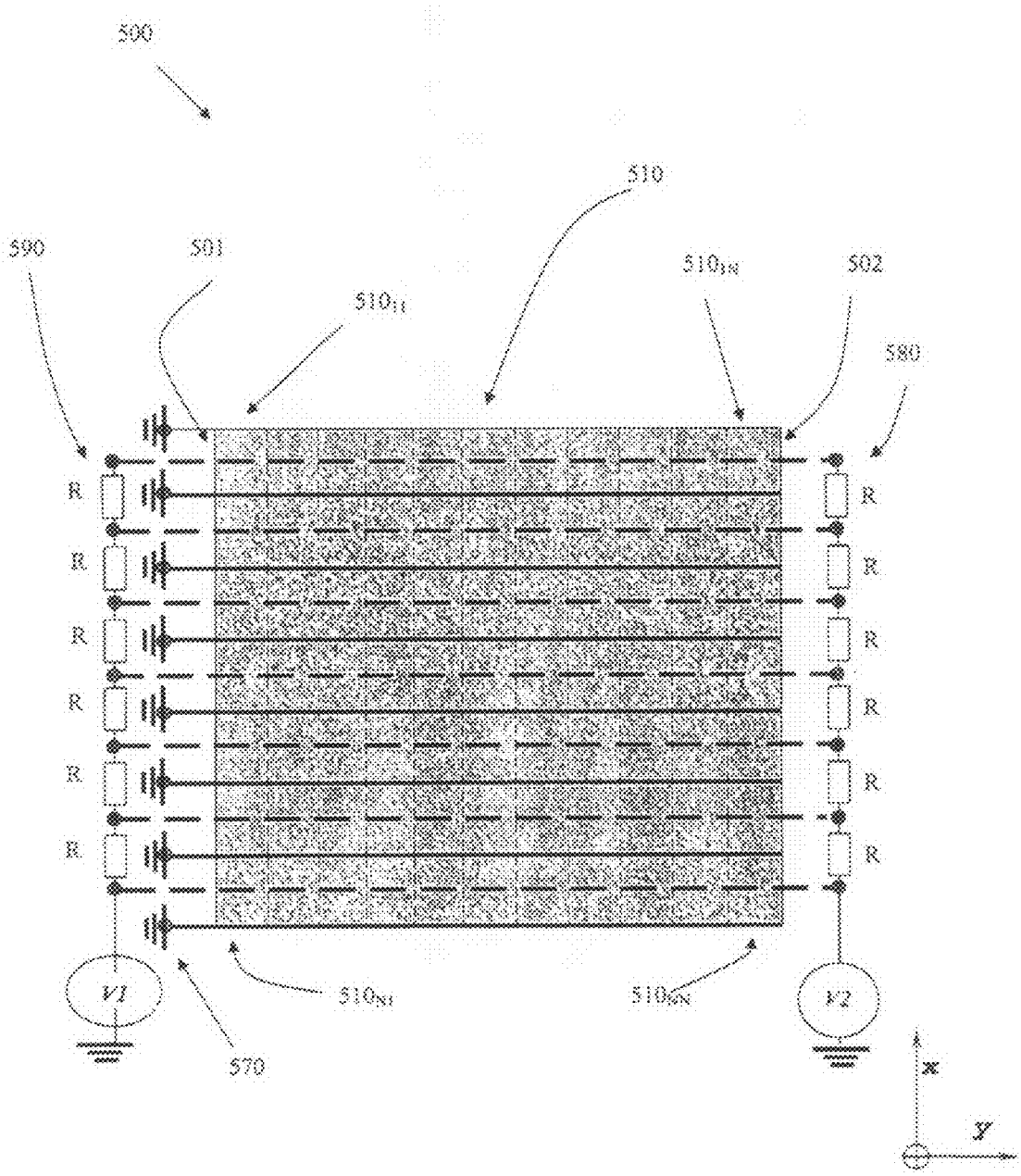
FIG. 5 shows a cross-section of a main surface of a second embodiment of a lens of the invention.

FIG. 5 shows a different embodiment 500 of the invention, by means of which the direction of the exiting electromagnetic beam can be controlled in both the x- and the y-direction, with renewed reference to the coordinate system shown in FIG. 3 and also in FIG. 5.

As with the previous embodiments, the embodiment 500 is based on a body of ferroelectric material 510. The lens 500 comprises one or several matching transformers at the main surfaces of the body, which is in similarity to the embodiment shown and explained in conjunction with FIGS. 2-4, for which reason the transformers will not be described again here.

The ferroelectric body 510 is also comprised of a plurality of slabs, $\mathbf{510}_{11}$-$\mathbf{510}_{NN}$, which in the drawing are shown as rectangular box-like structures arranged as a matrix with N rows and N columns. One of the slabs used in the embodiment 500 is shown in more detail in FIG. 6.

Figure 6:
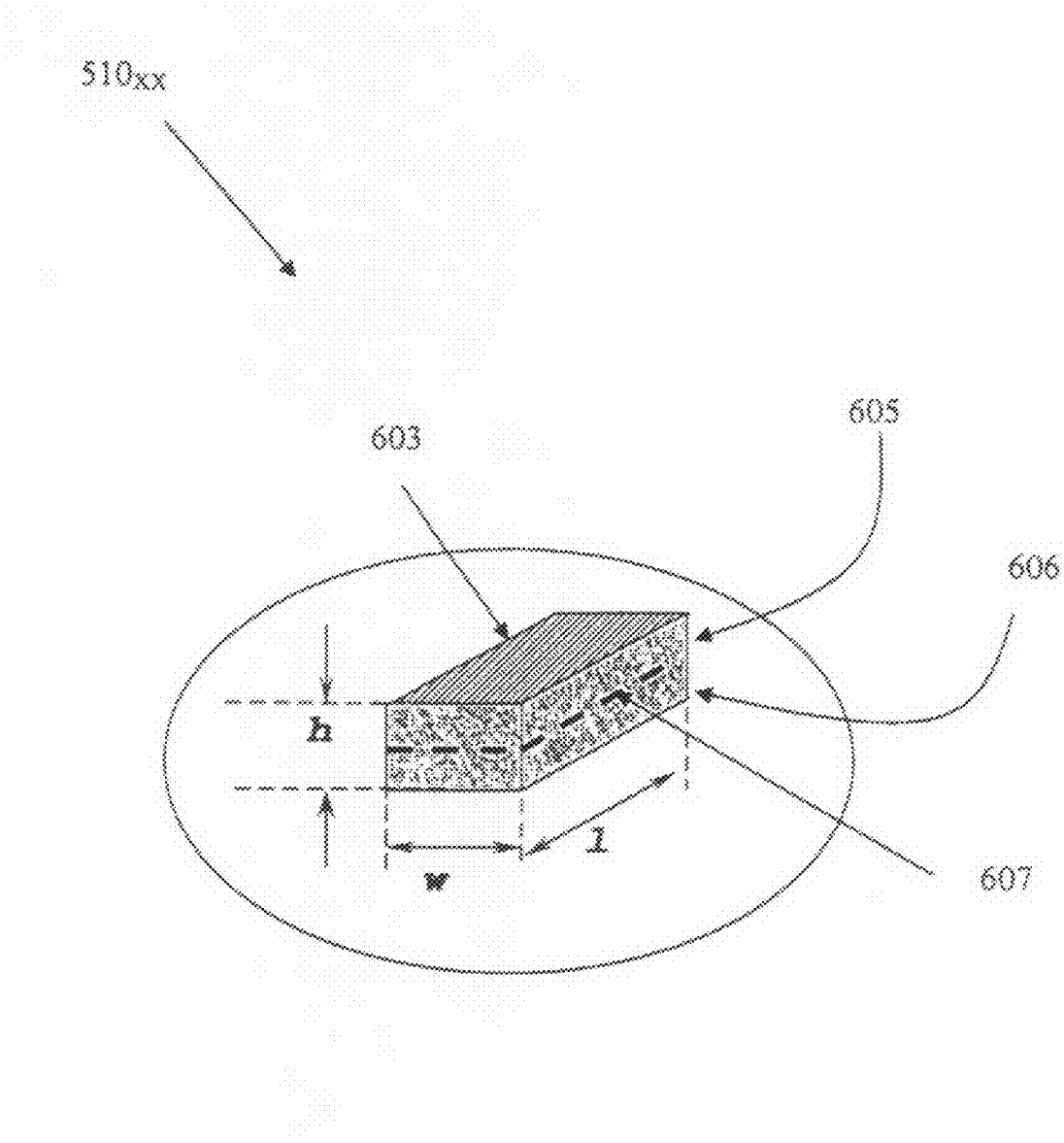
FIG. 6 shows a component in the second embodiment of a lens of the invention.

As with the slabs of the previous embodiment, the slab $\mathbf{510}_{XX}$ shown in FIG. 6 comprises a first and a second electrode, in the example arranged on a top 603 and a bottom surface of the slab. In further similarity to the slabs of FIGS. 3 and 4, the slab $\mathbf{510}_{XX}$ is rectangular and box-like, with a width w, a height h and a length l. The two surfaces (the front and rear "face" of the slab) defined by the width w and the height h of the slab form first and second main surfaces 507, 508, of the body 510 of ferroelectric material.

However, as opposed to the previously shown slabs, the slab or TEM-waveguide $\mathbf{510}_{XX}$ of the embodiment 500 has a two-layered structure, shown in FIG. 6, and composed as follows:

A first layer 605 of ferroelectric material is arranged on top of a second layer 606 of a ferroelectric material, suitably but not necessarily the same kind of ferroelectric material.

Between these two layers 605, 606, there is arranged a layer of conducting material, which is suitably a material with a high resistivity, for reasons which will become clear later on in this description. As with the slabs shown earlier, the slab $\mathbf{510}_{XX}$ can be seen as an elementary TEM-waveguide, and comprises a first and a second electrode of a conducting material with low resistivity, the first electrode 603 in this example being arranged on a "top" surface of the slab, and the second electrode 604 being arranged on the opposing bottom surface of the slab.

Thus, as shown in FIG. 5, in addition to the connection points of the arrangement shown in FIGS. 2 and 3, additional or intermediate connection points are created in between the connection points shown previously, the additional connection points being access points to the layer of high resistivity, which can be seen as a third electrode in each slab.

As show in FIG. 5, in addition to the ground means 570 and first means for creating a DC-gradient 580, the lens 500 comprises second means 590 for creating a DC-gradient in a second direction in the ferroelectric body 510. Suitably, as will be explained below, the direction of the second gradient is perpendicular to the direction of the first gradient created by the first means 580, but other directions are possible within the scope of the invention.

As shown in FIG. 5, the second means 590 for creating a gradient also comprises a DC-supply ($V_1$) connected to a number of voltage dividers, in this case resistors.

As can be seen in FIG. 5, the third electrodes 607 are connected to both of the voltage supplies $V_1$, $V_2$, the connections being made to one voltage supply $V_1$ on a first main edge 501 of the body 510, and to the other voltage supply $V_2$ on an opposing second main edge 502 of the body 510. In addition, the connections are made so that a first (in the "x"-direction) of the third electrodes 607 is connected to a first side of a first voltage divider in each of the two networks 580, 590, and the next (in the "x"-direction) of the third electrodes is connected to the second side of the first voltage divider, as well as being connected to a first side of the second voltage divider.

The next after that of the third electrodes is then connected to the second side of the second voltage divider. In short, the principle which will now have been realized is that one voltage divider from each of the DC-supplies, $V_1$, $V_2$, will connect two adjacent third electrodes.

The connection points which are created at the intersections between the slabs of the body 510 are also utilized in this embodiment, in this case by being connected to a grounding network or ground lines 570.

Using the principle described in connection to FIGS. 2-4, it will be realized that a DC-gradient can be created in the x-direction in the embodiment 500 as well, using either the voltage supply $V_2$ or $V_1$. Also, the reason for using a material with a high resistivity in the third electrode will also be realized: if there is a voltage difference between the DC-supplies $V_1$ and $V_2$ and the connection between them is not an ideal conductor, there will be an essentially linear voltage drop in the y-direction, by means of which a DC-gradient is created in that direction as well, by means of a voltage difference $V_1$-$V_2$.

Thus, by means of controlling the two voltage supplies $V_1$ and $V_2$, the dielectrical constant $\in$ of the board can be made to vary as a gradient in both the x- and the y-directions, by means of which the exit direction of the incident electromagnetic wave can be controlled in both directions, which was the desired result of the embodiment 500.

It should be mentioned here that in the ferroelectric body 510, in similarity to the ferroelectric body 210, the elements of one column, e.g. elements $\mathbf{510}_{11}$-$\mathbf{510}_{1N}$, can be one contiguous slab instead of discrete elements, i.e. the body 510 can consist of "boards" stacked on top of each, and other.

The embodiments shown above and in the appended drawings are merely examples to facilitate the understanding of the invention, it will be realized that many variations are possible, both when it comes to the structure of the TEM-waveguides ("slabs") and when it comes to the means for creating the DC-gradient field.

Figure 7:
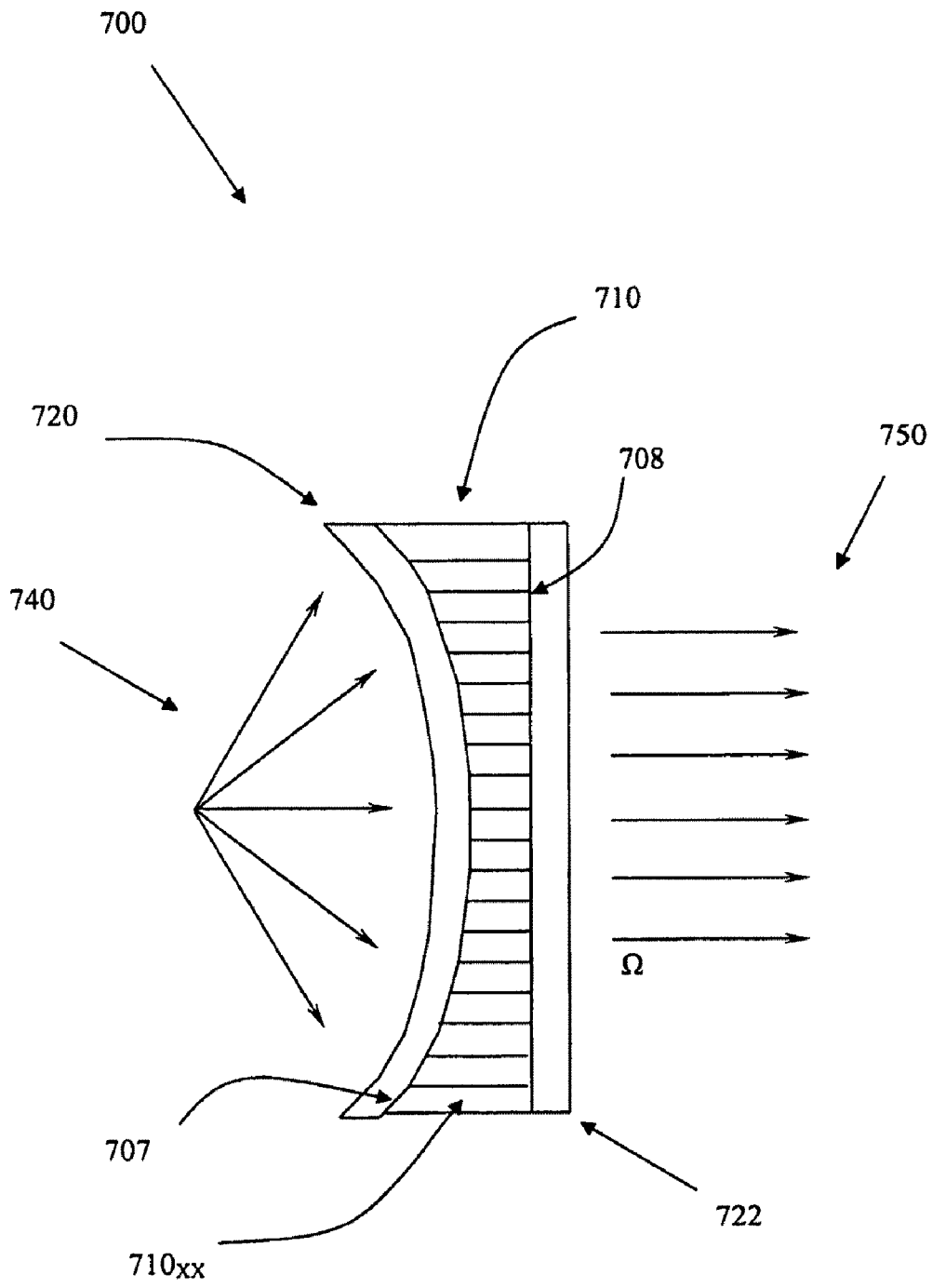
FIG. 7 shows a side cross-section of a third embodiment of the invention.

One example of an alternative embodiment 700 is shown in FIG. 7: the ferroelectric lens 700 comprises a ferroelectric body 710, with a matching transformer 720, 722, adjacent to each of two main surfaces 707, 708, of the ferroelectric body 710.

However, as an alternative, the lens 700 has a concave first main surface 707 and a plane second main surface 708, with the respective matching transformers 720, 722, having corresponding shapes. This shape of the components of the lens make it possible to, for example, shape the beam form and/or beam width of the output beam.

Some examples of materials and dimensions for a lens according to the invention will also be given. It should be pointed out that although these materials and examples are suitable for a lens according to the invention, these are examples only, and should not be seen as restricting the scope of the invention.

As an example of a suitable material for the ferroelectric slabs of the ferroelectric body, mention can be made of $Ba_xSr_{1-x}TiO_3$, where $0 \leqq x \leqq 1$.

When it comes to choosing materials for the matching transformers, any material with a suitable dielectric constant may be chosen, i.e. the following formula should be adhered to:

$$\in_{transformer} = \sqrt{\in_{ferr.lens}} \tag{1}$$

Regarding the dimensions, in other words w, h, l, of the "slabs" or TEM-waveguides in the body of ferroelectric material, the following can be said: the width w may be determined, for example, by ease of fabrication. In other words, the smaller the width w of the waveguides is, the higher the yield will be, if the waveguides are produced as parts of a larger block.

As for the height h, or that dimension which will be the height when the waveguides are arranged in the lens as shown above, the height h should be less than the half of the intended operating wavelength of the lens. Hence, we can talk about a specific height only in connection with a specific frequency. If, for example, the lens is to be designed to work at 10 GHz using ferroelectric with $\in$=200 m we then have:

$$h < \frac{3 \times 10^8}{2 \times 10^{10} \times \sqrt{200}} \approx 1.06 \text{ mm.}$$

Thus, the general formula for the height h of the slabs is:

$$h < \frac{c}{2 * f \times \sqrt{\varepsilon_{ferr}}} \tag{2}$$

where c is the speed of light, f is the intended operating frequency (centre frequency) of the lens, and $\in_{ferr}$ is the dielectric constant of the ferroelectric material used.

An example of a suitable height h of a slab is in the are of 0.5-1 mm. This is merely an example of a suitable value, and is in no way restrictive for the invention.

With suitable ferroelectric materials, a typical value of the control voltage would be 10V/μm in the direction in which the voltage is applied. Thus, in the case of a slab with h=1 mm, the control voltage would be 1 kV.

The length l of the slabs is defined by, among other things, the required range of the scanning angle of the lens. A typical value for l would be in the range of approximately 10-20 mm.

Regarding the matching transformers, their depth, i.e. the dimension which is perpendicular to the main surfaces of the body of ferroelectric material, the depth of the transformers should be a quarter-wavelength of the intended operating frequency. For the frequency 10 GHz and dielectric constant of ferroelectric ∈=200, and using equation (1) above for the dielectric constant of the transformer, we would thus have a transformer depth $d_{TRANS}$:

$$d_{TRANS} = \frac{3\times10^8}{4\times10^{10}\times(200)^{1/4}} \approx 2 \text{ mm}$$

As an example of a suitable material for the high resistivity film, mention may be made of $LaMnO_3/SrTiO_3$.

Figure 8A:
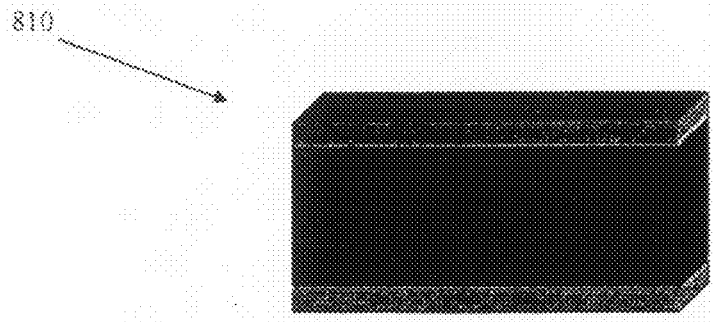
FIGS. 8*a* and 8*b* show a variation of the component of FIG. 6, and FIGS. 9*a* and 9*b* show versions of the invention.
Figure 8B:
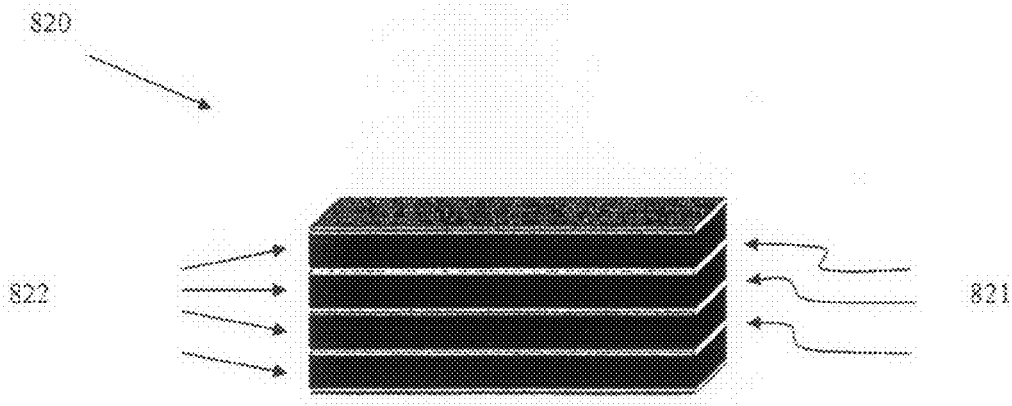

FIG. 8*b* shows a variation 820 of the waveguides shown above: in FIG. 8*a*, as background, the slab described above is shown, i.e. a rectangular box-like shape 810 of ferroelectric material, with two electrodes, one each on opposing surfaces of the box. In FIG. 8*b*, the waveguide is instead formed as a multilayer structure 820, i.e. it has alternating layers of ferroelectric material and conductors. Thus, in addition to the top and bottom electrodes shown previously, the waveguide 820 alternatingly has intermediate electrodes or electrode layers 821, and intermediate ferroelectric layers 822.

Figure 9A:
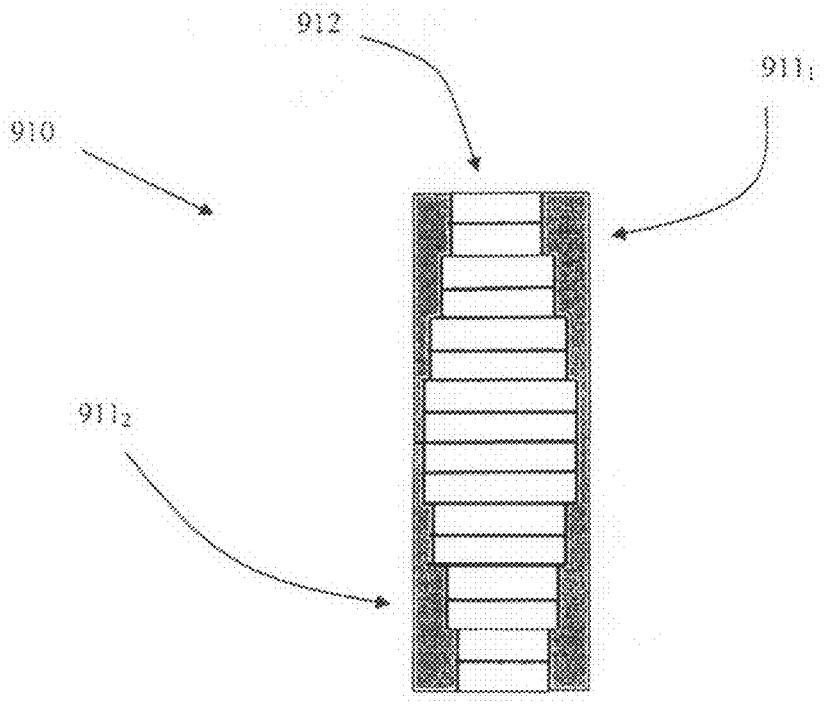
Figure 9B:
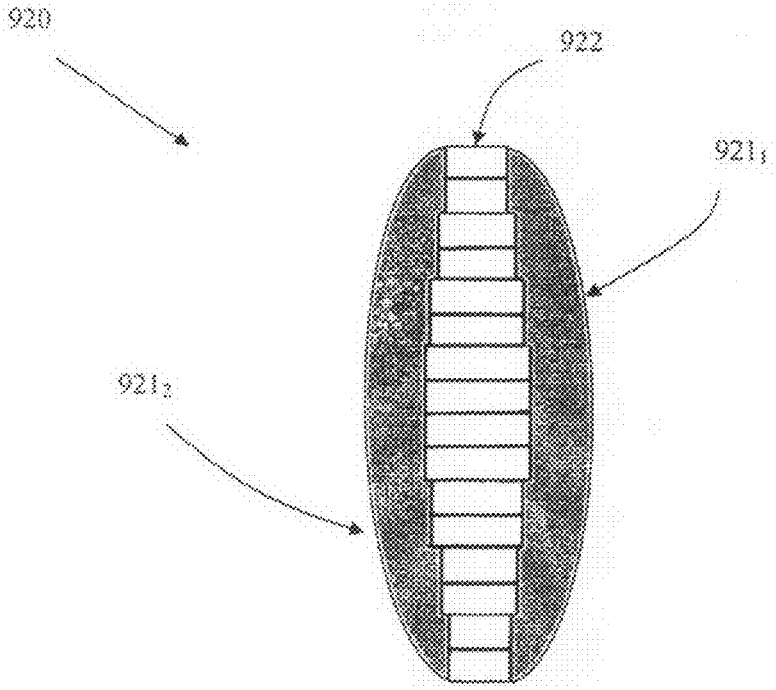

FIGS. 9*a* and 9*b* show versions 910 and 920 of a lens according to the invention seen from the same perspective as in FIG. 2 above, i.e. a cross sectional view from the side. As shown in FIGS. 9*a* and 9*b*, the waveguides of the ferroelectric body 921, 922 can be of different lengths, the dimension l described previously. In addition, FIGS. 9*a* and 9*b* show alternative versions 911, 921, of the transformers used with the body of ferroelectric material: since the waveguides of FIGS. 9*a* and 9*b* are of different lengths, the main surfaces of the bodies of ferroelectric material are not smooth. However, the transformers 911, 921, are adapted to this, i.e. the ∈ of the transformer for each waveguide is determined by (1), and the thickness of the transformer for each waveguide is λ/4.

Additionally, the surface of the transformers 911, 921, which is intended to face outwards from the lens 910, 920 is smooth, but in the case of FIG. 9*a*, the lens 910 comprises two transformer parts $\mathbf{911}_1$, $\mathbf{911}_2$, one arranged adjacent to each main surface of the body of ferroelectric material 912, and which both have a straight outer edge which is arranged to coincide with a main direction of extension of the body 912 of ferroelectric material.

In the case of FIG. 9*b*, the lens 920 comprises also two transformer parts $\mathbf{921}_1$ $\mathbf{921}_2$, one arranged adjacent to each main surface of the body of ferroelectric material 912. However, the outer edge of these transformer parts is convex, giving the resulting lens an essentially oval shape.

Figure 10:
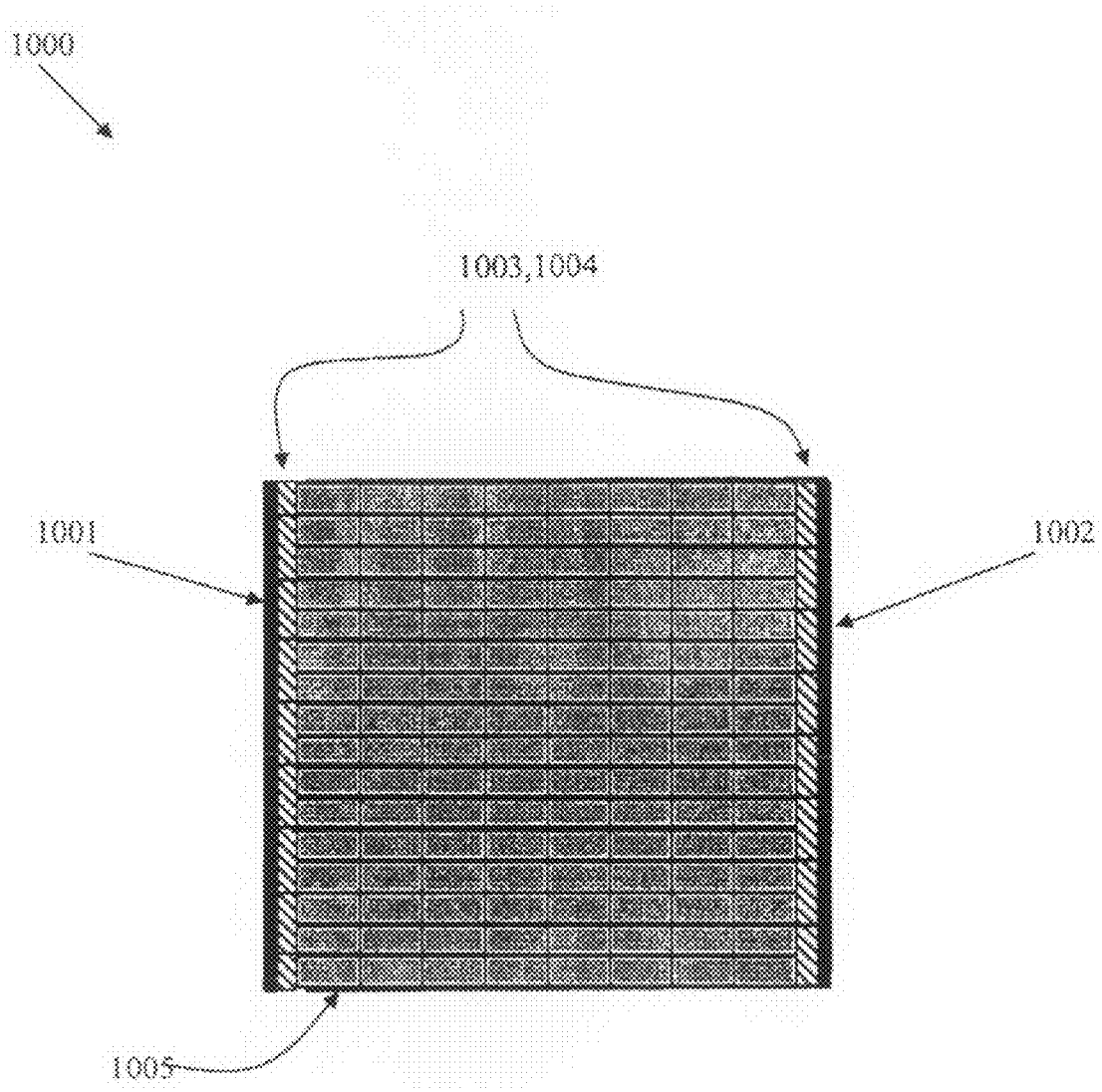
FIG. 10 shows a more detailed embodiment of the invention.

In FIG. 10, a lens 1000 of the invention is shown in the same perspective as in FIGS. 3 and 5, i.e. a cross sectional view showing one of the main surfaces of the lens, as well as the transformers 1001, 1002. FIG. 10 intends to show a practical detail which may be of use when manufacturing a lens of the invention: as described previously, the lens 1000 comprises a plurality of electrodes 1005 and connections between the electrodes and means for creating DC-voltages as shown in, for example, FIGS. 3 and 5. In order to prevent interference and short circuits between the different connections to the DC-voltage, a special isolating layer 1003, 1004, may need to be arranged on one or both sides of the main surface of the ferroelectric body, if that is where the connections between the DC-means and the electrodes are made. Thus, the connections will be "embedded" in the isolating layer 1003, 1004, and isolated from each other. The material for the isolating layer may be chosen from among any of a number of well-known isolating materials.

Figure 11A:
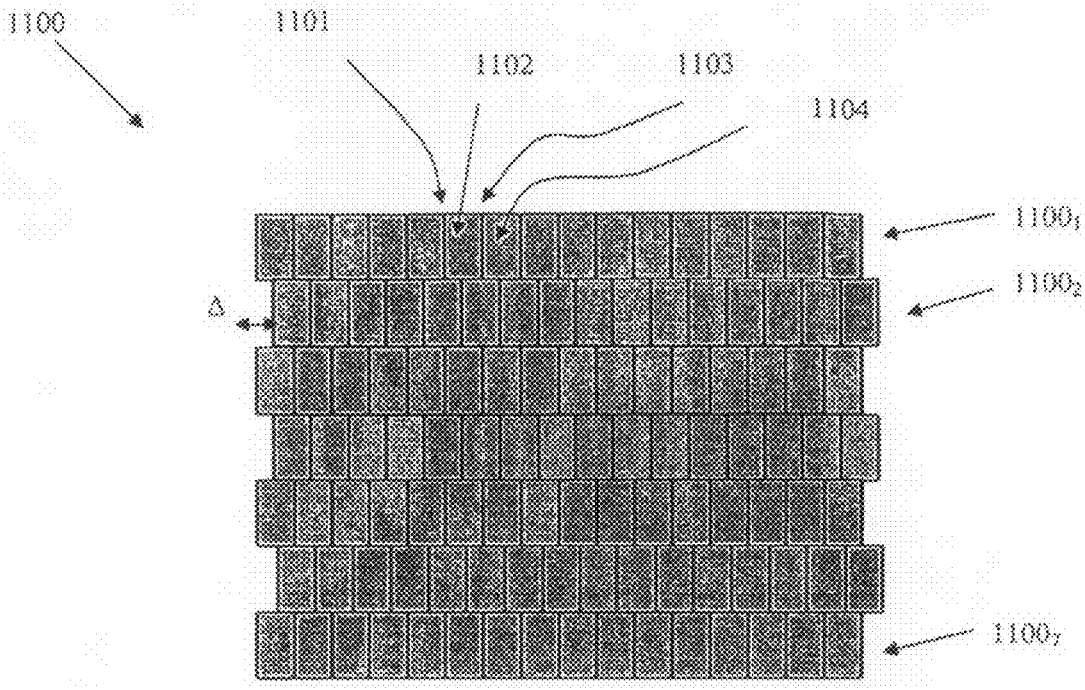
FIGS. 11*a* and 11*b* show alternative embodiments of the lens of the invention.

FIG. 11*a* shows another embodiment 1100 of a lens according to the invention, seen in the same perspective as the lens in FIG. 3, 5 or 10: in the same manner as the lenses described hitherto, the lens 1100 comprises a number of TEM-waveguides made of a ferroelectric body, and arranged so that they together form a body of ferroelectric material. For the sake of clarity, the transformers and DC-means are not shown in FIG. 11, since they can be the same as those shown previously.

The main difference between the embodiment 1100 and those shown previously is the following: the TEM-waveguides of the lens 1100 are equipped with a first and a second electrode, but not on those sides which will face the waveguides in the rows below and, where applicable, above. Instead, the waveguides of the lens 1100 have a first and a second electrode on those sides which face neighbouring waveguides in the same row.

This is illustrated using two adjacent waveguides 1102 and 1104 in the lens 1100. Thus, the waveguide 1102 has a first 1101 and a second 1103 electrode on each of said sides, and shares the second electrode 1103 with the waveguide 1106 which is immediately adjacent to it on that side.

As can be seen in FIG. 11*a*, the waveguides are arranged so that the electrodes of the waveguides in one row do not risk coming into contact with the electrodes of the waveguides in the adjacent rows. Suitably, this is done as shown in FIG. 11*a*: the rows $\mathbf{1100}_1$-$\mathbf{1100}_7$ are alternatingly displaced a distance Δ with respect to the immediately adjacent rows, so that the electrodes of the waveguides in one row will not risk coming into contact with the electrodes of the waveguides in the surrounding rows.

One benefit of the embodiment of FIG. 11*a* is that each waveguide can be addressed individually, as opposed to the previously shown embodiments. Thus, for example, the electrodes 1101 and 1103 will be used to address waveguide 1102, etc. In this embodiment, the DC-biasing network is suitably arranged in the plane of the main surface of the ferroelectric body.

Naturally, an embodiment where each waveguide can b addressed individually will naturally allow for greater flexibility when it comes to shaping the gradient in the ferroelectric body.

Figure 11B:
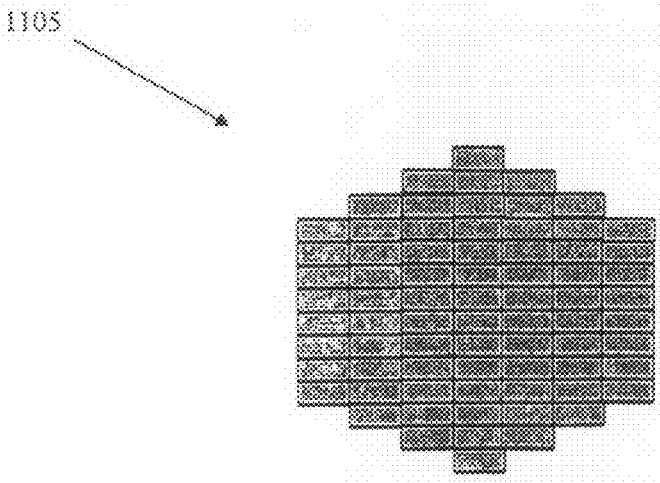

FIG. 11*b* shows an alternative embodiment 1105 of the lens shown in FIG. 11*a*. The waveguides of FIG. 11*b* are similar to those in FIG. 11*a*, the main difference is that they are not arranged in rows with equal numbers of waveguides, thus giving the main surface of the ferroelectric body a slightly oval shape.

Figure 12:
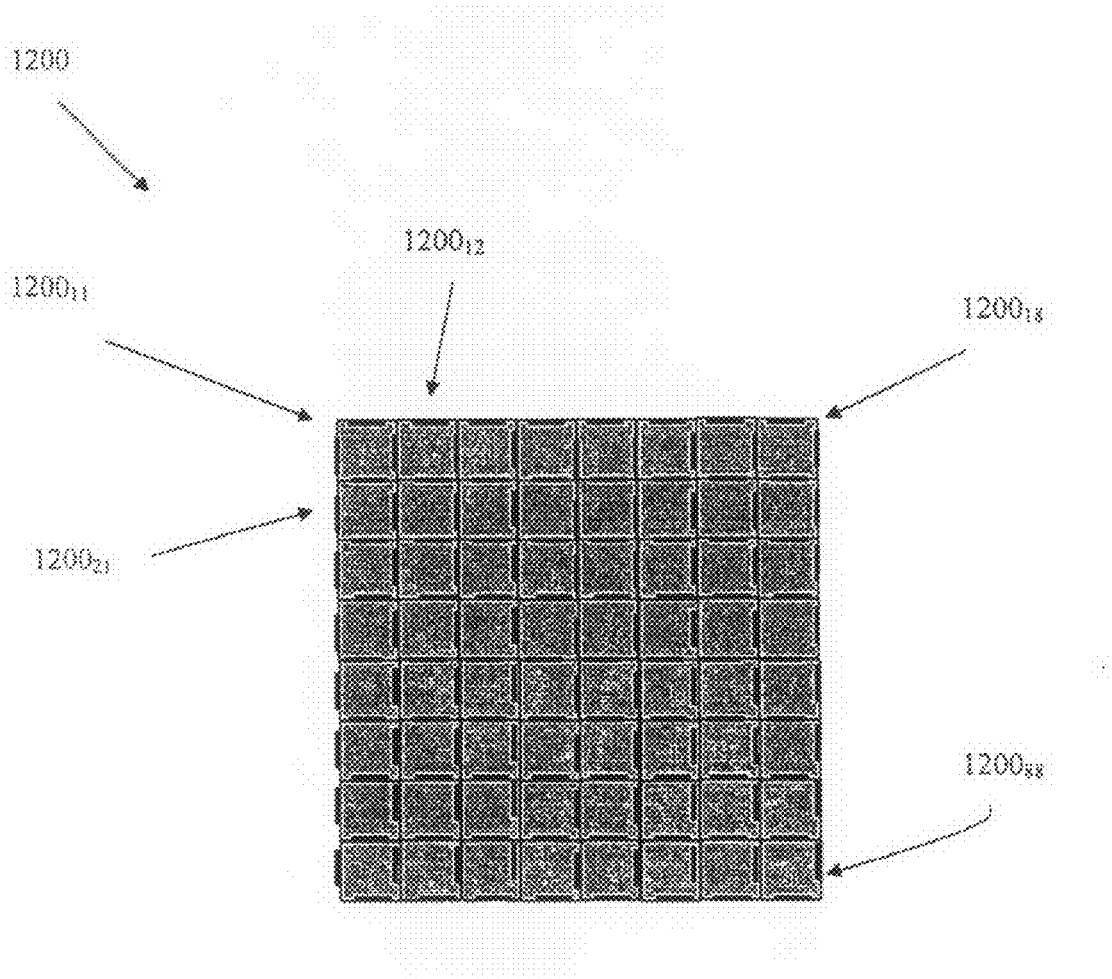
FIGS. 12 and 13 show versions of another alternative embodiment of a lens according to the invention.

The embodiment shown in FIG. 11 is one where each waveguide can be addressed individually, but where the gradient(s) can only be created in one direction. FIG. 12 shows an embodiment where this is improved upon: in the lens 1200, which is shown in the same perspective as that in FIG. 11, there is a plurality of waveguides, in this case 64 waveguides, arranged in regular rows and columns to form an a 8*8 matrix. A plurality of these waveguides, in the present example all of them, have a first, a second, a third, and a fourth electrode.

In the example shown, the waveguides are rectangular and box-like, with a basic structure similar to that shown in FIG. 4. The waveguides used in the lens 1200 have their electrodes arranged so that there is one electrode on each of those sides of the "box" or "slab" which do not contribute in forming either of the main surfaces of the lens 1200. Thus, each waveguide (apart from those situated in the outer rows) will have one electrode in common with one of the other waveguides which surround it on each side.

As an example, consider waveguide $\mathbf{1200}_{11}$: this waveguide has four electrodes, one on each of said sides. The waveguide $\mathbf{1200}_{11}$ has one electrode on one side in common with the neighbouring waveguide in the "y"-direction, using the same coordinate system as previously, i.e. waveguide $\mathbf{1200}_{12}$.

Additionally, waveguide $\mathbf{1200}_{11}$ also has one of its electrodes in common with the neighbouring waveguide $\mathbf{1200}_{21}$ in the "x"-direction. Since waveguide $\mathbf{1200}_{11}$ is arranged in the upper left hand corner of the matrix, and thus has no neighbours in two directions, two of the electrodes will not be shared with any of the other waveguides but the principle will have been realized.

With the embodiment shown in FIG. 12, each waveguide can thus be addressed individually, and be controlled to have an individual DC-voltage in two directions, which leads to an antenna or lens which can have beam steering in two directions.

As mentioned in conjunction with the embodiments shown in FIGS. 3 and 5, a great advantage of the invention is that the E-field of the incident wave will be essentially parallel to the E-field of the biasing network. With the embodiment of FIG. 12, even greater flexibility regarding the E-field of the incident electromagnetic wave can be allowed, since the E-field of the biasing network can be controlled with a greater degree of flexibility, thus allowing the E-field of the incident wave to have basically any polarization.

Also, it should be pointed out that the embodiment shown in FIG. 12, it will be possible to create "local gradients" within the lens, i.e. areas within the lens with different dielectrical constants, $\in$.

Figure 13A:
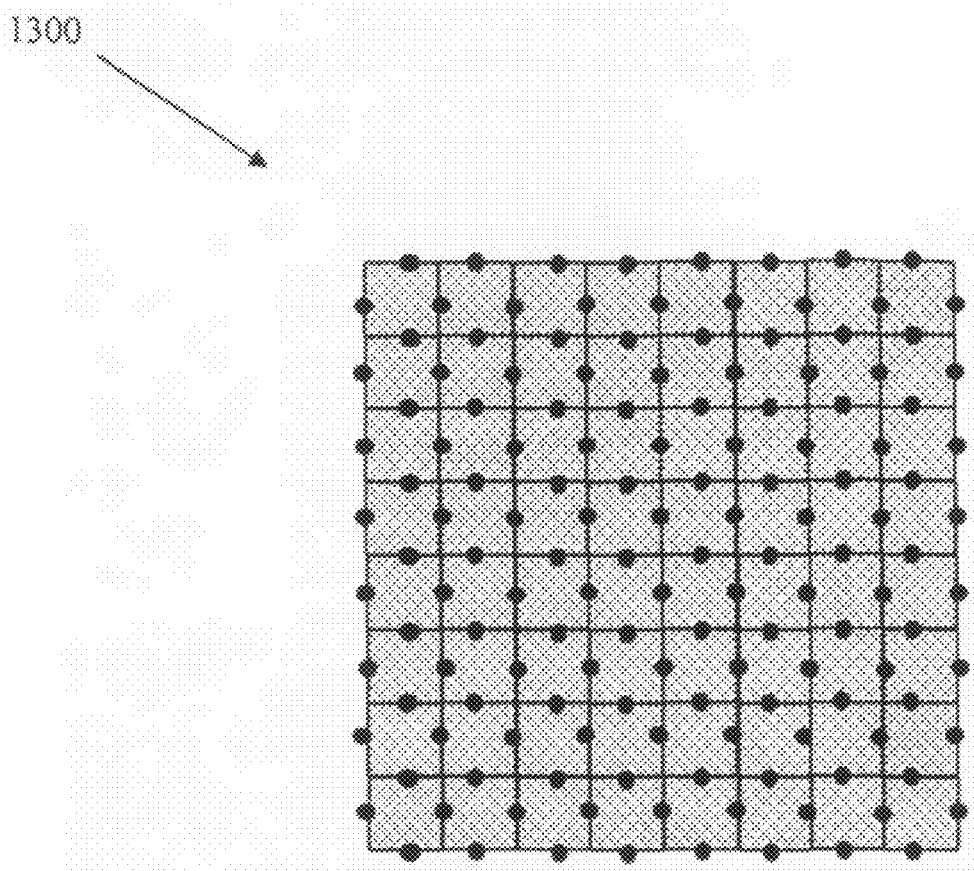

Finally, FIG. 13*a* shows the same basic concept as that in FIG. 12, but also illustrates how the electrodes may be designed: until now, the electrodes have been shown as basically flat. This is one embodiment, but as shown in FIG. 13*a*, they may also be circular in their cross-sectional shape.

Figure 13B:
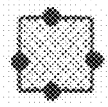

FIG. 13*b* shows one of the individual waveguides of FIG. 13*a*.

The invention is not limited to the examples of embodiments shown above, but may be varied freely within the scope of the appended claims. Thus, the waveguides may be given any number of cross sectional shapes, as is well known in waveguide technology. For example, cross sectional shapes which could be possible are round, oval, hexagonal, etc.

Also, the waveguides of the invention can be used within other applications. For example, the waveguides could be used as phase shifters in hybrid integrated circuits.

The invention claimed is:

1. A lens for steering an exit direction (Ω) of an electromagnetic wave which is incident upon the lens, the lens comprising a main body with a first and second main surface and a first transformer which is adjacent to said first main surface of said main body, said electromagnetic wave entering the lens through said first transformer and exiting the lens through the second main surface, the main body comprising a plurality of discrete slabs of ferroelectric material, each slab in said plurality also comprising a first and a second electrode of an electrically conducting material, the slabs additionally comprise at least a third resistive electrode of an electrically conducting material where the third resistive electrode is located between the first and the second electrodes, said lens additionally comprising means for grounding the first and second electrodes on said plurality of slabs, first means for creating a first DC field in a first direction in the main body using a first voltage divider network and the third resistive electrodes, the first means for creating a first DC field is located on the first main surface of the main body such that a dielectric constant in the main body will also be a gradient in said first direction thus enabling steering of the exiting electromagnetic wave, said first direction being essentially parallel to said first main surface of the main body, and second means for creating a second DC field in a second direction in the main body using a second voltage divider network and the third resistive electrodes, the second means for creating a second DC field is located on the second main surface of the main body, said second direction parallel to at least one of said first and second surfaces of the main body, but non-coincidental with the first direction of the first DC-field, by means of which the dielectric constant in the main body is caused to be gradient in said second direction as well, thus enabling additional steering of the exiting electromagnetic wave in said second direction as well.

2. The lens of claim 1, in which said third resistive electrode is made from a material with a high resistivity.

3. The lens of claim 1, additionally comprising a second transformer which is adjacent to said second main surface of said main body, each of the first and second transformers being arranged adjacent to one of the main surfaces of the main body so that said electromagnetic wave will enter the lens through one of said transformers and exit through the other of said transformers.

4. The lens of claim 3, in which the first and second transformers are adapted to facilitate the transition of the incident electromagnetic wave through the main body.

5. The lens of claim 1, in which the slabs in said plurality of slabs have an elongated box-like shape with essentially the same width (w), height (h) and length (l), and are arranged in rows and columns parallel to each other in the main body, the length of the box thus defining the distance travelled by the electromagnetic wave in the main body, and the width and height defining sub-areas of the first and second main surfaces of the main body.

6. The lens of claim 1, in which the first and second electrodes are arranged on opposing sides of each of the slabs.

7. The lens of claim 1, in which each slab consists of two smaller slabs arranged adjacently to each other, the third resistive electrode being a layer with high resistivity arranged between the two smaller slabs.

8. The lens of claim 1, wherein each slab has the first electrode arranged on a top surface and the second electrode arranged on a bottom surface, where the plurality of slabs are positioned in a matrix such that the slabs arranged adjacent to each other in a x-direction have mechanical and galvanic contact between the first electrodes on the top surfaces thereof and also have mechanical and galvanic contact between the second electrodes on the bottom surfaces thereof, where the slabs that are arranged on top of one another in a y-direction have the second electrodes of each slab in contact with the first electrodes of each slab located immediately below except for the uppermost and lowermost slabs.

* * * * *

UNITED STATES PATENT AND TRADEMARK OFFICE

CERTIFICATE OF CORRECTION

PATENT NO. : 7,777,683 B2
APPLICATION NO. : 11/721271
DATED : August 17, 2010
INVENTOR(S) : Tageman et al.

It is certified that error appears in the above-identified patent and that said Letters Patent is hereby corrected as shown below:

On the title page, item (75), under "Inventors", in Column 1, Line 2, delete "Gevorgyan," and insert -- Gevorgian, --, therefor.

On the title page, item (75), under "Inventors", in Column 1, Line 4, delete "Filhol," and insert -- Fihol, --, therefor.

On the title page, item (57), under "ABSTRACT", in Column 2, Line 9, delete "(21011-210NN, 51011-510NN)" and insert -- ($210_{11}$-$210_{NN}$, $510_{11}$-$510_{NN}$) --, therefor.

Signed and Sealed this
Eleventh Day of January, 2011

David J. Kappos

David J. Kappos
*Director of the United States Patent and Trademark Office*